United States Patent [19]

Lowen

[11] 3,950,914

[45] Apr. 20, 1976

[54] BUILDING ELEMENTS

[75] Inventor: Michael David Lowen, Berkhamsted, England

[73] Assignee: John Laing & Son Limited, London, England

[22] Filed: Sept. 12, 1974

[21] Appl. No.: 505,337

[30] Foreign Application Priority Data

Sept. 20, 1973 United Kingdom ..... 44128/73

[52] U.S. Cl. ..... 52/749; 212/9; 214/1 H

[51] Int. Cl.[2] ..... E04F 21/18; E04G 21/22

[58] Field of Search ..... 52/749; 214/1 H; 212/1, 212/8 R, 8 B, 9, 41, 42; 33/88, 286

[56] References Cited

UNITED STATES PATENTS

| | | | |
|---|---|---|---|
| 1,469,200 | 9/1923 | Wallace | 212/41 |
| 1,521,246 | 12/1924 | Lichtenberg | 212/41 |
| 2,599,552 | 6/1952 | Harney | 52/749 |
| 2,692,527 | 10/1954 | Wetzel et al. | 33/286 |
| 3,039,233 | 6/1962 | Holmes | 52/749 |
| 3,167,864 | 2/1965 | Lange | 33/88 |
| 3,177,621 | 4/1965 | Demarest | 52/749 |
| 3,384,247 | 5/1968 | Teagle | 214/1 H |
| 3,498,473 | 3/1970 | Spaulding et al. | 212/41 |
| 3,685,673 | 8/1972 | Schweis | 212/8 B |

FOREIGN PATENTS OR APPLICATIONS

| | | | |
|---|---|---|---|
| 890,736 | 3/1962 | United Kingdom | 212/8 R |
| 1,302,121 | 7/1962 | France | 212/8 B |

*Primary Examiner*—Ernest R. Purser
*Assistant Examiner*—James L. Ridgill, Jr.
*Attorney, Agent, or Firm*—Kenyon & Kenyon Reilly Carr & Chapin

[57] ABSTRACT

An apparatus for the accurate placing of building elements such as bricks or blocks which has an assembly rotatably mounted on a support which is itself mounted for movement parallel and normal to a guideway. The assembly includes means for dispensing and placing jointing or packing material such as mortar prior to the placing of a building element and gripper means for transferring the building elements from a supply area to a predetermined placement point. The apparatus also includes means for rotating the assembly relative to the support and alignment means which, when the apparatus is in use, position the assembly independently of the building elements already placed.

13 Claims, 11 Drawing Figures

BUILDING ELEMENTS

The present invention relates to apparatus for positioning elements and more particularly, although not exclusively, to the laying of building elements such as bricks or blocks, the apparatus being hereinafter referred to, for convenience, as "bricklaying apparatus" and the elements as bricks.

Several forms of bricklaying apparatus are known, but their major shortcomings have been in the lack of flexibility of the brick placing arrangements to form various bond patterns or cavity walls and the difficulty of turning corners or working within restricted ends.

Presenting the apparatus to the working area has also been cumbersome involving the use of rails on platforms or a machine which rides on the wall as it is being built, with the resultant limitations at openings and corners. Another method is to have the apparatus suspended from a travelling gantry which can cover the whole of the area under construction but this, of course, involves much effort in erection and problems in transporting the apparatus to the site.

Furthermore none of the known forms of apparatus have the versatility to enable them to handle bricks and blocks of varying sizes. Also only a few have any facility for programming their actions.

The main object of the present invention is to provide a bricklaying apparatus which, in use, is in spatial relationship with the bricks being laid so that the use of rails, platforms, gantrys, or the like is rendered unnecessary, i.e. the apparatus is positioned and controlled from datum points in space so that alignment is effected without any necessity for manual checking of line and level of the bricks already laid.

It is a further object of this invention to provide an apparatus which is able to place bricks in varying arrangements according to a predetermined programme to form cavity walling, corners, brickwork within restricted ends and walls of various bond patterns.

The present invention consists in an apparatus for the accurate placing of elements comprising an assembly rotatably mounted on a support which is itself mounted for movement parallel and normal to a guideway, said assembly including means for dispensing and placing jointing or packing material prior to the placing of an element and element gripper means for transferring elements from a supply area to a predetermined placement point, means for rotating said assembly relative to the support and alignment means which, in use, position the assembly independently of the elements already placed.

Figure 1:
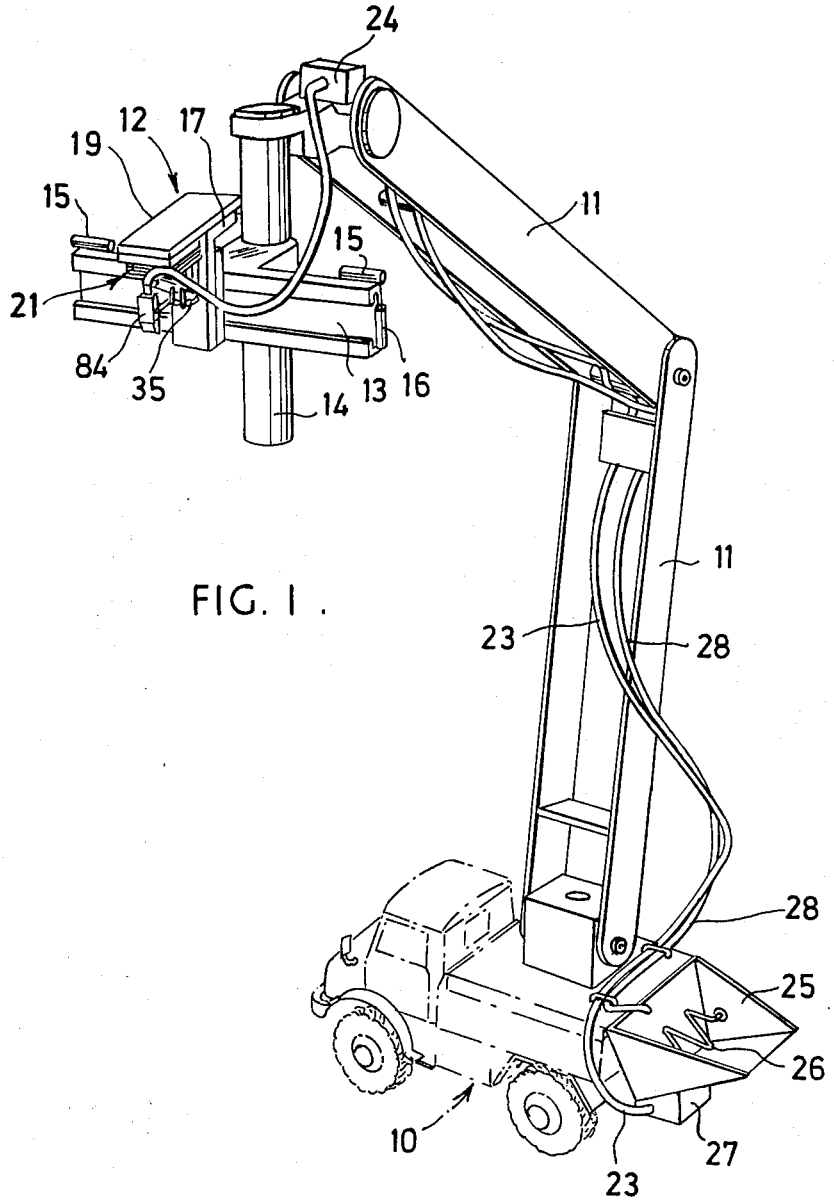
Figure 2:
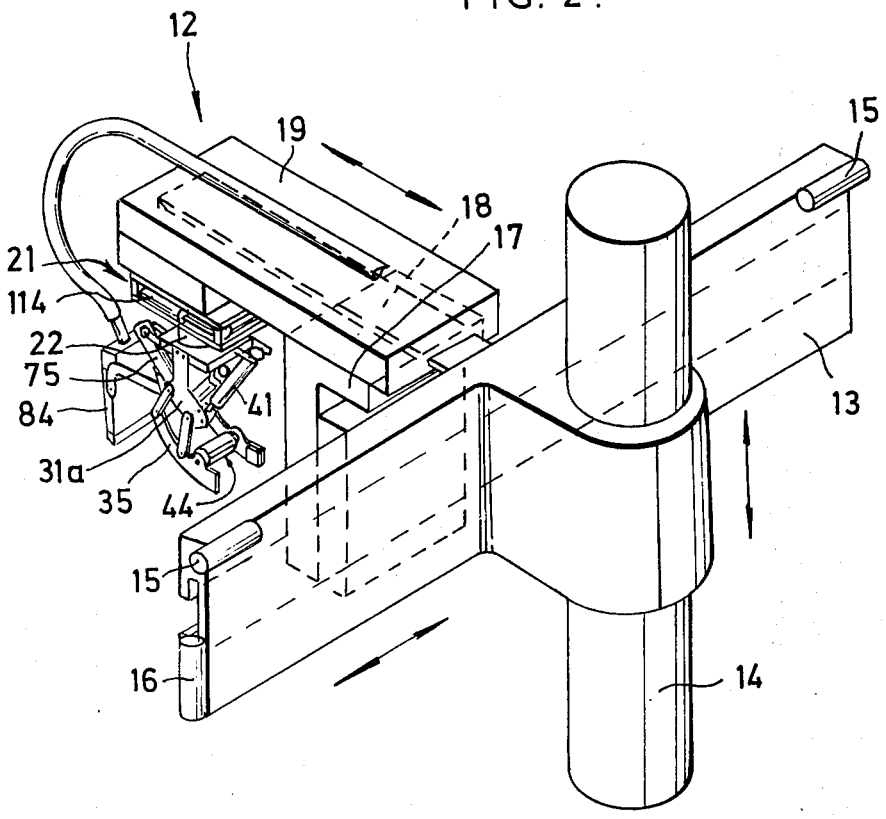
Figure 3:
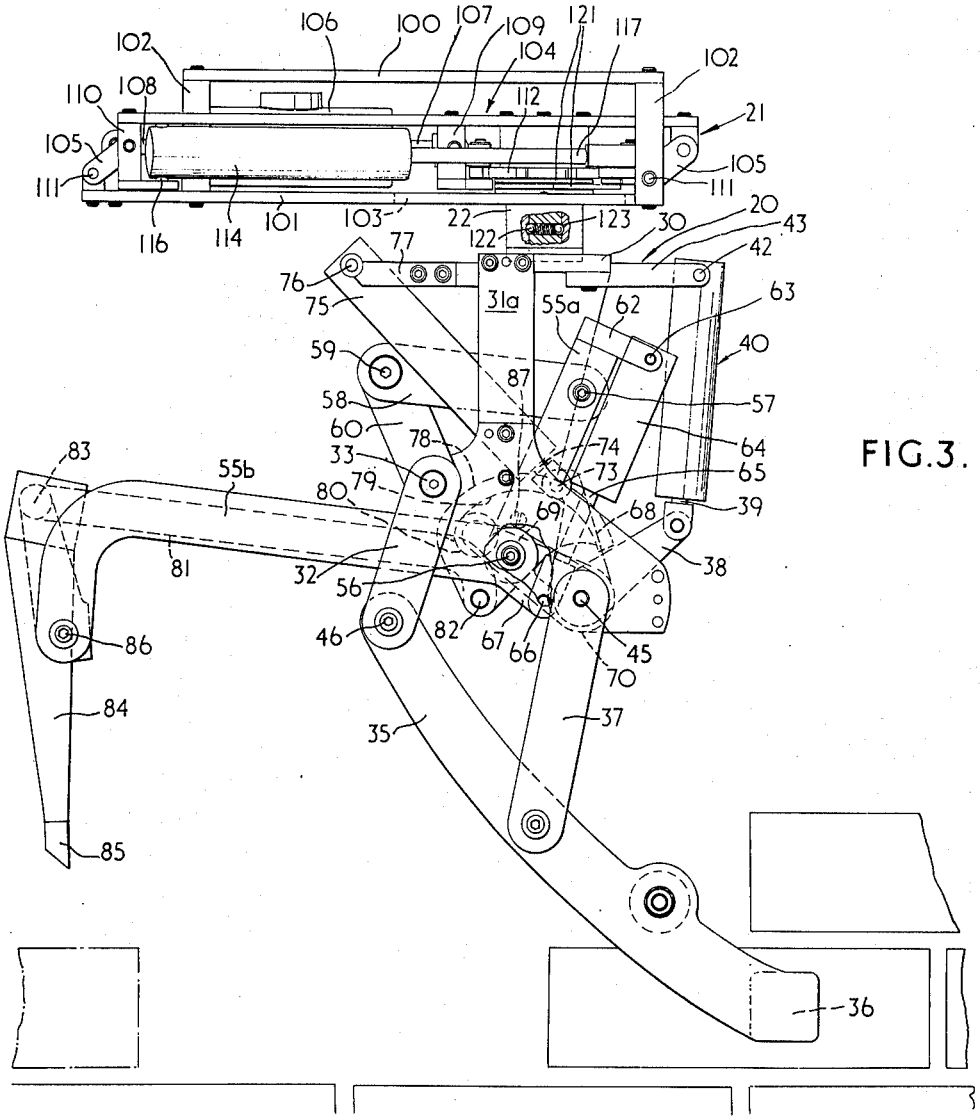
Figure 4:
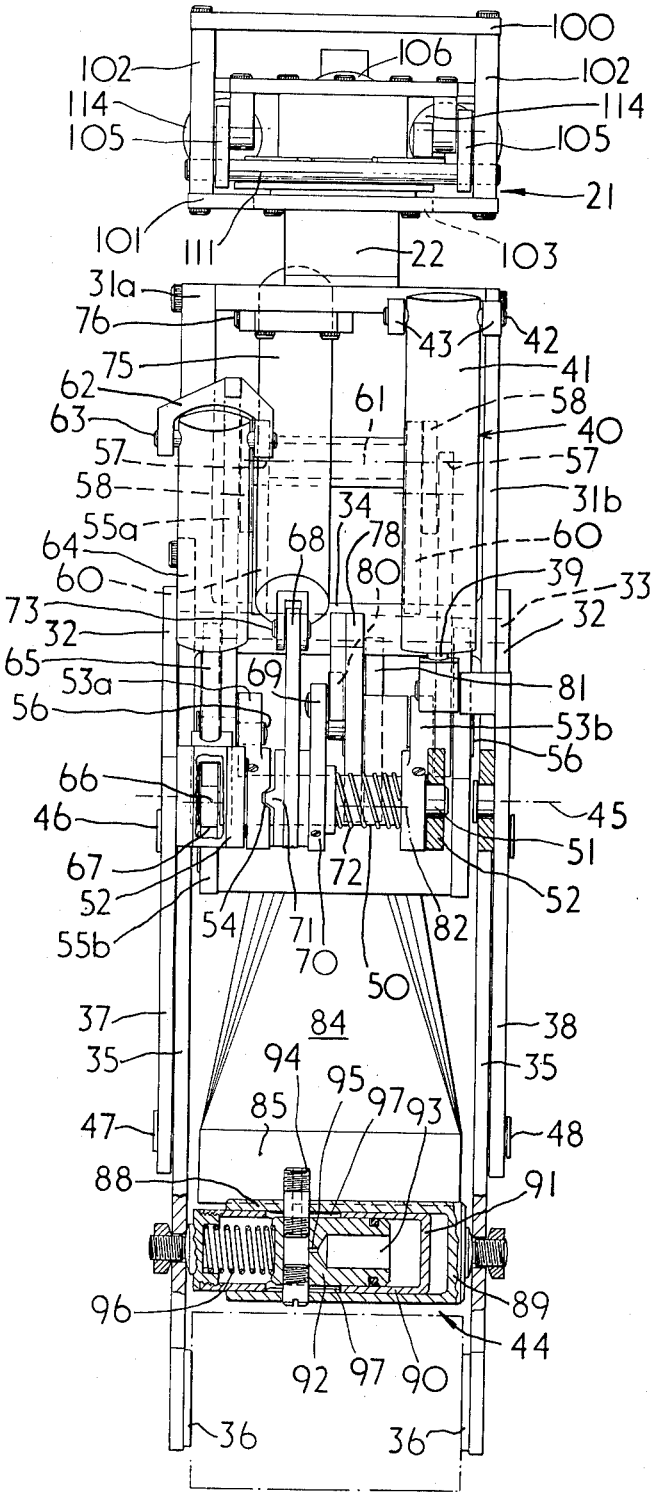
Figure 5:
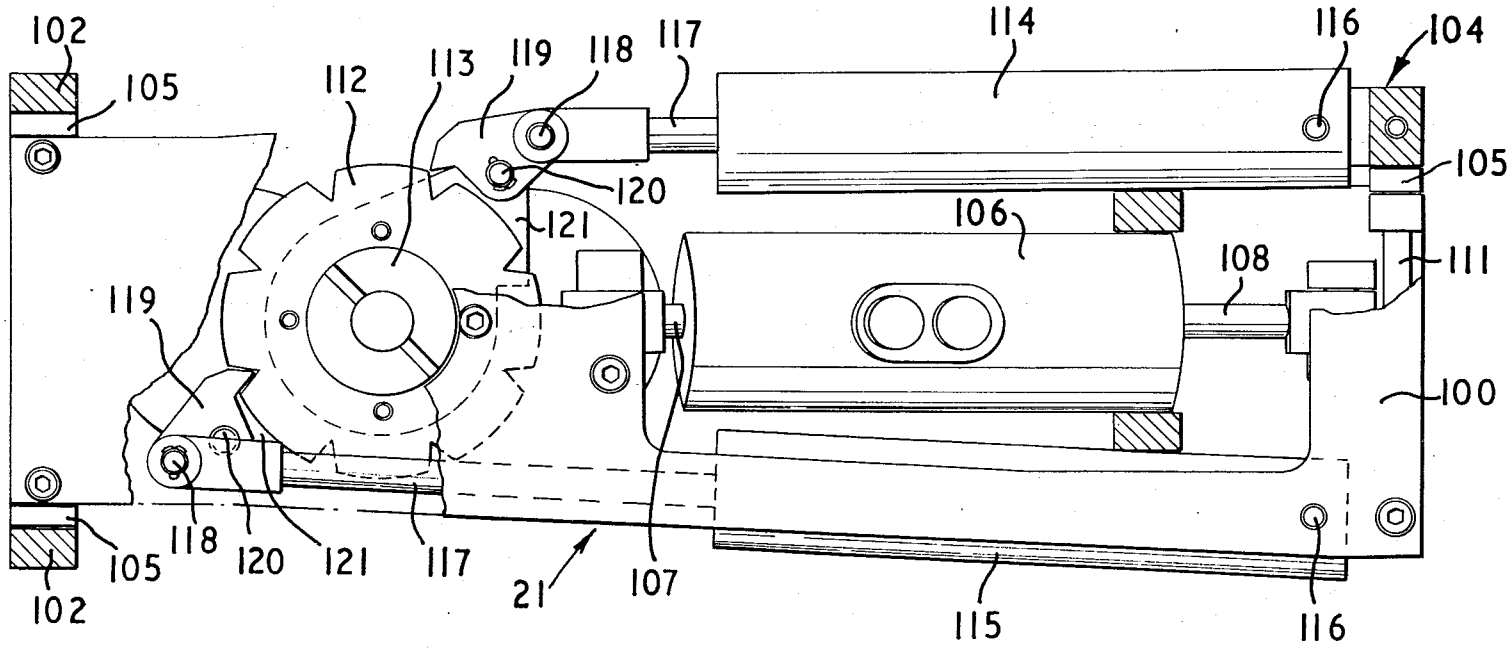
Figure 6:
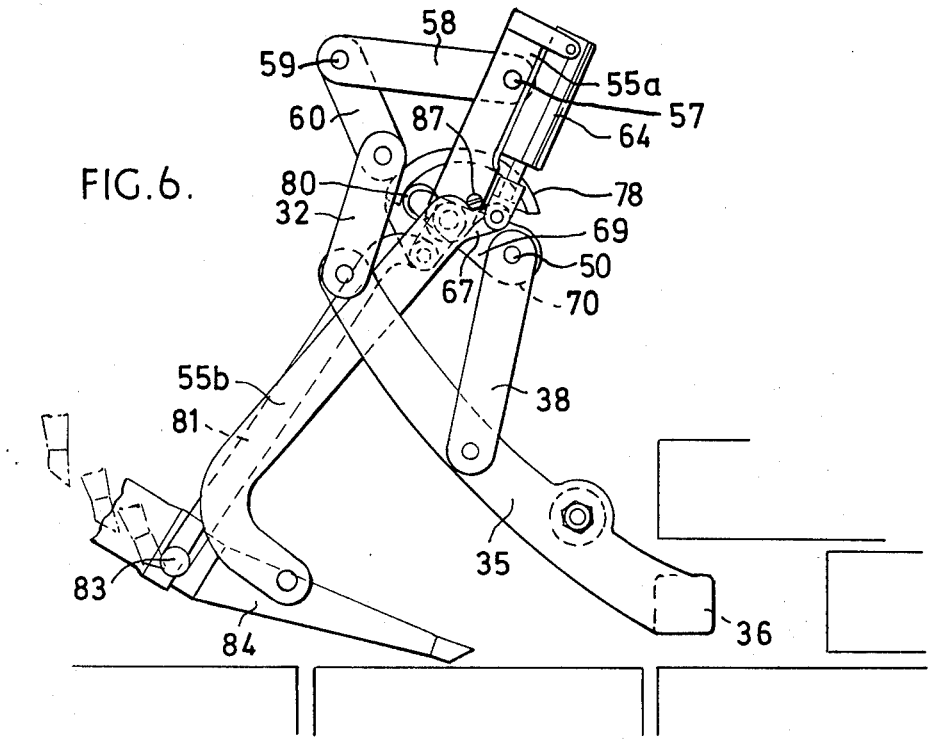
Figure 7:
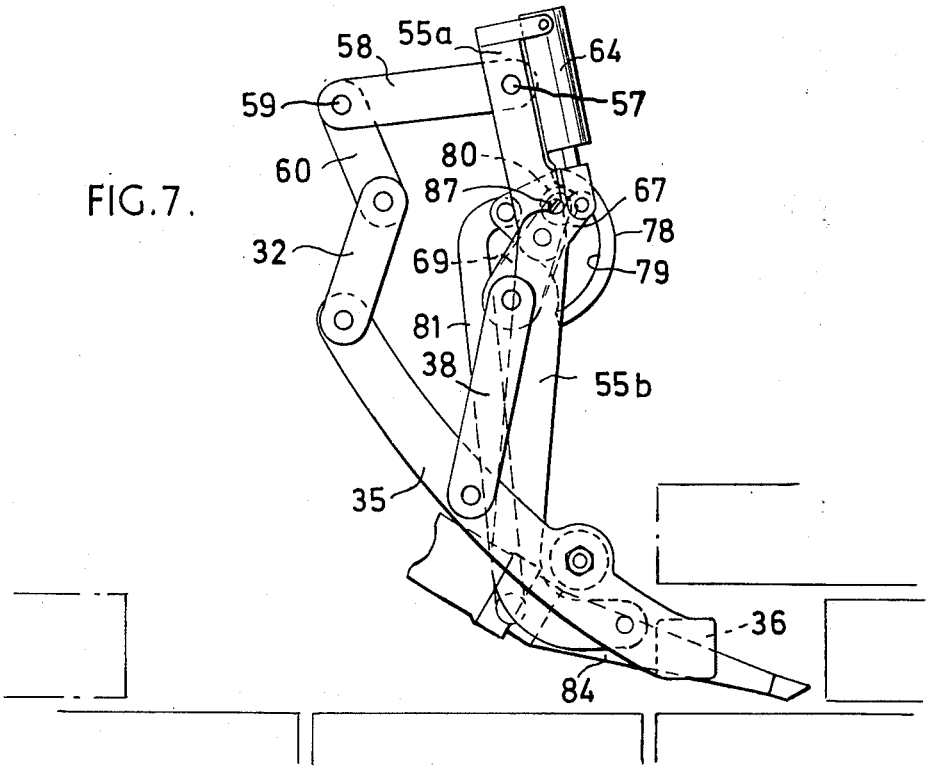

In the accompanying drawings:

FIG. 1 is a perspective view of an apparatus for positioning building elements according to the present invention with certain parts omitted for clarity, FIG. 2 is a perspective view from the rear of the upper assembly of the apparatus shown in FIG. 1, FIG. 3 is a side view showing details of the element handling head indicated in FIG. 2, FIG. 4 is an end view of FIG. 3, FIG. 5 is a plan view of FIG. 3, FIGS. 6 to 11 are simplified views of parts of the linkage shown in FIG. 3 showing a sequence of movements of the linkage.

In carrying the invention into effect according to one convenient mode, by way of example, the bricklaying apparatus basically comprises a wheeled vehicle 10 having an upwardly extending articulated structure 11 rotatably mounted on the body of the vehicle with a bricklaying and mortar applying assembly 12 mounted on the upper end of the articulated structure 11.

The upper assembly 12 comprises a horizontally extending guideway 13 slidably mounted on a vertical column 14 which depends controllably from the upper end of the articulated structure 11. Alignment telescopes 15 are positioned on the opposite ends of the guideway 13 which, in use, extend parallel to the course of bricks being laid. A further telescope 16 is mounted vertically on the guideway. Alignment of the guideway 13 within the required operational area is effected via the telescopes 15 and 16 with reference to predetermined marks.

A bracket 17 is slidably mounted for movement along the guideway 13 and its upper surface is provided with a further guideway 18 which extends at right angles to the first mentioned guideway 13. A cross traverse member 19 is slidably mounted on the further guideway 18 and a bricklaying and mortar applying head or assembly 20 has an indexing mechanism 21 fixedly mounted on the traverse member 19. The head 20 is rotatably mounted in the indexing mechanism housing by means of a vertically extending shaft 22 about a vertical axis and is capable of rotating through 360°, with indexing at 90° angular intervals of motion about the vertical axis and is readily interchangeable with other heads suitable for handling other sizes of building bricks or blocks.

Mortar or other jointing material is supplied to the head 20 through a means such as a flexible hose 23 and a metering valve 24 from a hopper 25 mounted on the vehicle 10. The hopper 25 is provided with an agitator 26 which maintains the mortar in a workable condition and a circulating pump 27 raises the mortar to the head 20 at a rate in excess of any working demand, the surplus mortar being returned to the hopper 25 via a return hose 28.

A brick supply station (not shown) is positioned adjacent the head 20 and bricks conveyed to this point by any convenient means e.g. an endless conveyor are picked up by brick handling mechanism now to be described.

The bricklaying and mortar-applying head 20 comprises a bracket assembly or frame of generally inverted channel-shaped configuration having an upper horizontally disposed plate 30 fixed to the shaft 22 and spaced, downwardly depending side plates 31*a*, 31*b*, accommodating various pivot axes as hereinafter described.

The brick-handling mechanism comprises spaced swinging links 32 pivotally mounted, respectively, on the side plates 31*a*, 31*b* and rigidly interconnected by a spindle 33 extending through a hollow shaft 34 fixedly connected at each end, respectively, to the side plates 31*a*, 31*b* to form part of the bracket assembly. The end of each link 32 remote from the shaft 33 is pivotally connected at 46 to one end of a gripper arm 35, the other end of which is provided with a brick gripper pad 36. One gripper arm 35 is pivoted intermediate its ends at 47, to an idler link 37, the other end of which is pivotally mounted on the bracket side plate 31*a* about an axis 45. The other gripper arm 35 is pivoted intermediate its ends at 48 to a cranked drive link 38 pivotally mounted intermediate its ends on the bracket side plate 31*b* about the axis 45. The upper end of the drive link 38 is pivotally connected to the piston rod 39 of a hydraulic piston-and-cylinder arrangement 40, the cylinder 41 of which depends downwardly from, and is pivotally connected at 42 between spaced outriggers 43 forming part of the bracket assembly. It will be readily appreciated that the piston and cylinder arrangement 40 and associated links 37, 38 serve as a means for pivoting the gripper arms 35 in unison in a vertical plane. To this end, extension of the piston rod 39 of the piston-and-cylinder arrangement 40 causes a clockwise movement of the drive link 38 about the axis 45 and a resultant clockwise swinging movement or retraction, of the gripper arms 35.

The lower end of the gripper arms 35 are interconnected by a hydraulic piston-and-cylinder arrangement 44 comprising an outer cylinder 88 having a means for moving the arms 35 horizontally towards each other to grip a brick therebetween. This means includes a closed end 89 and an inner cylinder 90 slidably mounted in the cylinder 88 with a closed end 91 positioned adjacent the closed end 89 of the outer cylinder 88. The outer cylinder 88 is fixedly attached to one of the gripper arms 35 whilst the inner cylinder 90 is fixedly attached to the other gripper arm 35. A hollow piston 92 having an open end 93 which communicates with a fluid inlet pipe 94 via a bore 95 is slidably mounted in the inner cylinder 90 and urged towards the closed end 91 by a spring 96. The inlet pipe 94 passes through, and is attached to, the outer cylinder 88 and piston 92, the sliding movement of the latter being permitted by diametrically opposed slots 97 formed in the inner cylinder 90. It will be seen that fluid entering the interior of the piston 92 from the inlet pipe 94 causes the inner cylinder 90 to be moved to the right as viewed in FIG. 4 which causes the gripper arm 35 to which it is attached to be moved towards the other gripper arm 35 in order to grip a brick. Upon the fluid pressure being released, the spring 96 re-asserts itself moving the inner cylinder 90 towards the left as viewed in FIG. 4, to effect a corresponding separating movement of the arm 35 to which it is attached.

The mortar applying mechanism comprises a hollow shaft 50 rotatably journalled on a spindle 51 extending between spaced bracket flanges 52 integral with the side plates 31*a*, 31*b*, the axis of the spindle 51 being coincident with the axis 45. Spaced arms 53*a*, 53*b* are fixedly attached to the shaft 50 in the same angular relationship so that they rotate in unison upon rotation of the shaft 50. The boss of the arm 53*a* has a female dog-clutch surface 54 for a purpose hereinafter described.

Spaced articulated links, arranged in parallel relationship and each having an upper portion 55*a* and a lower portion 55*b* are pivotally interconnected by a pin 56 to the respective arms 53*a*, 53*b*. Each upper portion 55*a* is pivotally connected at 57 to one end of an arm 58, the other end of which is pivotally mounted at 59 to a support member 60 fixedly connected to the hollow shaft 34 forming part of the bracket assembly. The pivot 59 is provided by a shaft 61 to which each of the arms 58 is rigidly connected.

The upper extremity of the articulated link portion 55*a* is provided with a yoke 62 on which is pivotally mounted at 63, a piston-and-cylinder arrangement 64, the piston rod 65 of which is pivotally connected at 66 to a lever 67 integral with the lower portion 55*b* of the articulated link. A mortar-applying nozzle 84 is positioned between and pivoted midway along its length at 86 to the adjacent end of the lower portions 55*b* of the articulated link.

A drive arrangement mounted on the bracket assembly for pivoting the nozzle 84 in a vertical plane parallel to the plane in which the gripper arms are pivoted vertically has two arms 68 and 69 angularly displaced from one another and integral with a boss 70 which is itself rotatably mounted on the hollow shaft 50. One face of the boss 70 is provided with a male dog-clutch surface 71 which is urged towards the female dog-clutch surface 54 by a spring 72. The end of the drive arm 68 is pivotally connected at 73 to the piston rod 74 of a hydraulic piston-and-cylinder arrangement 75, the cylinder of which is pivotally mounted at 76 on an outrigger 77 of the bracket assembly.

The pin 56 interconnecting the arm 53*b* to the upper and lower portions 55*a*, 55*b* of the articulated link also has a cam plate 78 pivotally mounted thereon. The cam profile 79 of the plate 78 is engaged by a roller 80 mounted on the extremity of the drive arm 69. The cam plate 78 has one end of a nozzle displacement link 81 pivotally connected thereto at 82, the other end of which is pivotally connected at 83 to the extremity of the nozzle 84 remote from its outlet 85.

The indexing mechanism 21 comprises a housing formed by upper and lower plates 100 and 101 respectively which are interconnected by vertical pillars 102. The upper plate 100 is fixedly mounted on the cross traverse member 19 and the lower plate 101 is provided with a longitudinally extending slot 103 through which extends the shaft 22.

A frame 104 is mounted for limited, longitudinal, swinging movement relative to the index mechanism housing by pairs of spaced links 105 positioned, respectively, at each end of the frame 104 on the extremities of a common shaft 111. The swinging movement of the frame 104 is effected by a double-acting piston-and-cylinder arrangement 106, the piston rods 107, 108, of which are connected, respectively, to an intermediate member 109 of the frame 104 and to an end member 110 thereof adjacent the links 105.

The shaft 22 is mounted on the frame 104 for movement therewith and the upper end of the shaft is provided with a ratchet wheel 112 which is rotatable about a fixed spindle 113. A pair of spaced, hydraulic piston-and-cylinder arrangements 114, 115 are pivotally mounted, respectively, at 116 on the frame 104 and extend longitudinally along each side thereof. Each piston rod 117 of the respective piston-and-cylinder arrangements is pivotally connected at 118 to a pawl member 119 which is itself pivotally mounted at 120 to a pawl plate 121, the latter being rotatable about the fixed spindle 113.

It will be seen that the pawl members 119 are engageable with the diametrically opposite portions of the ratchet wheel 112 and that selective extension of the respective piston rods 117 enables rotation of the ratchet wheel 112 in opposite directions to be obtained. Accurate indexing at 90° intervals is obtained by diametrically opposed spring-loaded balls 112, which are urged outwardly from the fixed spindle 113 into recesses 123 formed in the adjacent surface of the shaft 22. It will be appreciated that the rotation of the head 20 by the ratchet-and-pawl mechanism just described enables "header" bricks to be positioned at right angles to a wall being built, whilst the swinging movement of the head 20 obtained by the links 105 produces the required movement for placing a header brick.

The operational sequence of the mortar-applying linkage will now be described with reference to FIGS. 6 to 11. Retraction of the piston rod 65 into the piston-and-cylinder arrangement 64 swings the lower portions 55*b* of the articulated link anti-clockwise about their pivot pins 56 until they engage an abutment 87 on the upper portions 55*a* at which time they have reached the position shown in FIG. 6.

The piston rod 74 of the piston-and-cylinder arrangement 75 is now extended which swings the drive arms 68 and 69 clockwise about the shaft 50. The resultant clockwise movement of the roller 80 moves the cam plate about its pin 56 against a spring pressure and progressively raises the nozzle displacement link 81 so that the nozzle 84 moves clockwise about its pivot 76 during anti-clockwise movement of the articulated link to obtain a substantially horizontal movement of the nozzle outlet 85 as mortar emerges therefrom. At the termination of this movement the linkage has reached the position shown in FIG. 7.

Figure 8:
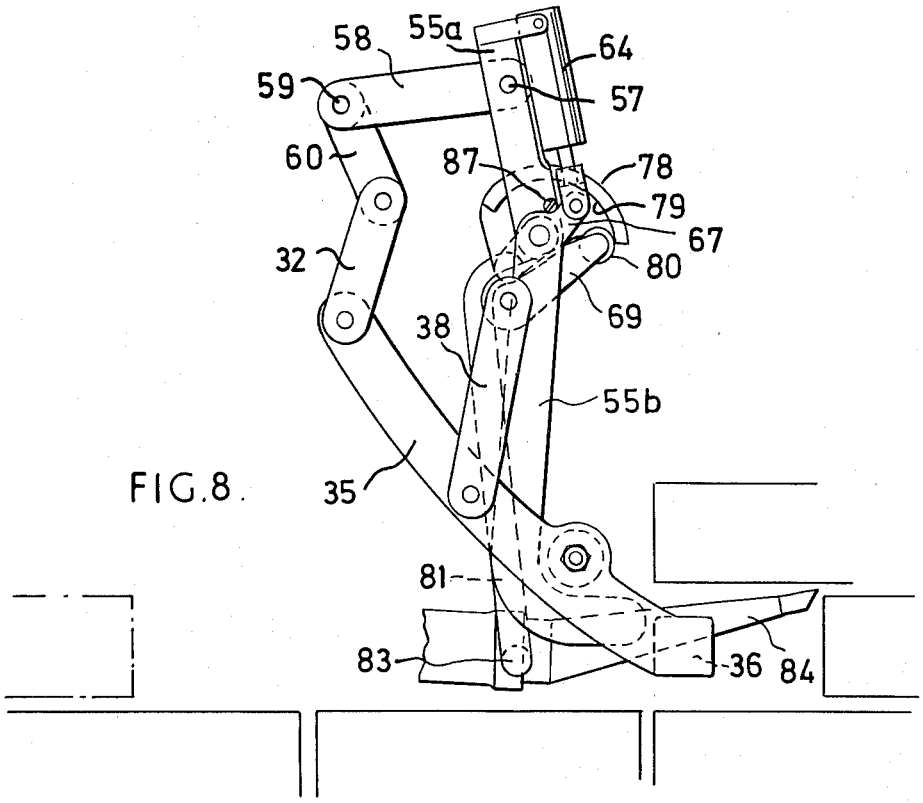

At this point, continued extension of the piston rod 74, disengages the clutch surface 71 from the clutch surface 54 and the continued clockwise movement of the drive arms 68 and 69 causes the roller 80 which is engaged with the cam profile 79 to rotate the cam plate 78 anticlockwise about its pin 56 further increasing the spring pressure and so urges the nozzle displacement link 81 downwardly to cause anti-clockwise movement of the nozzle 84 about its pivot 86 and a resultant upward movement of the nozzle outlet 85 to the position shown in FIG. 8. During this movement mortar discharges onto the end surface of a previously laid brick.

Figure 9:
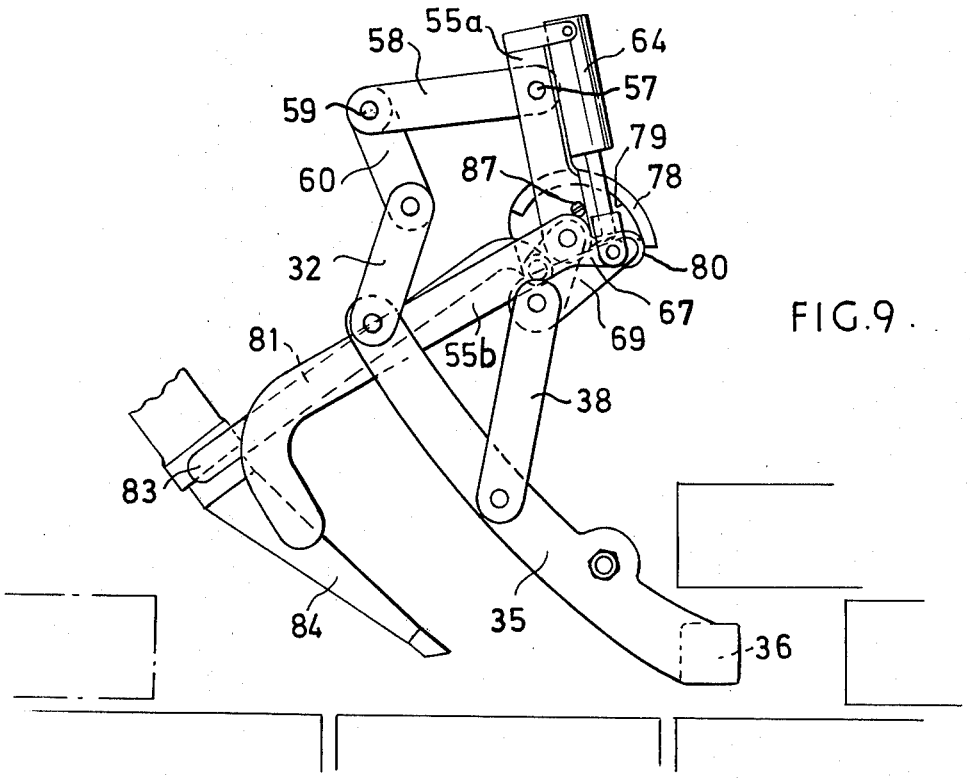

The piston rod 65 of the piston-and-cylinder arrangement 64 is now fully extended which causes the lower portion 55*b* of the articulated link to rotate clockwise relative to the upper portion 55*a* about its pivot pin 56 until the nozzle 84 is retracted to the position shown in FIG. 9.

Figure 10:
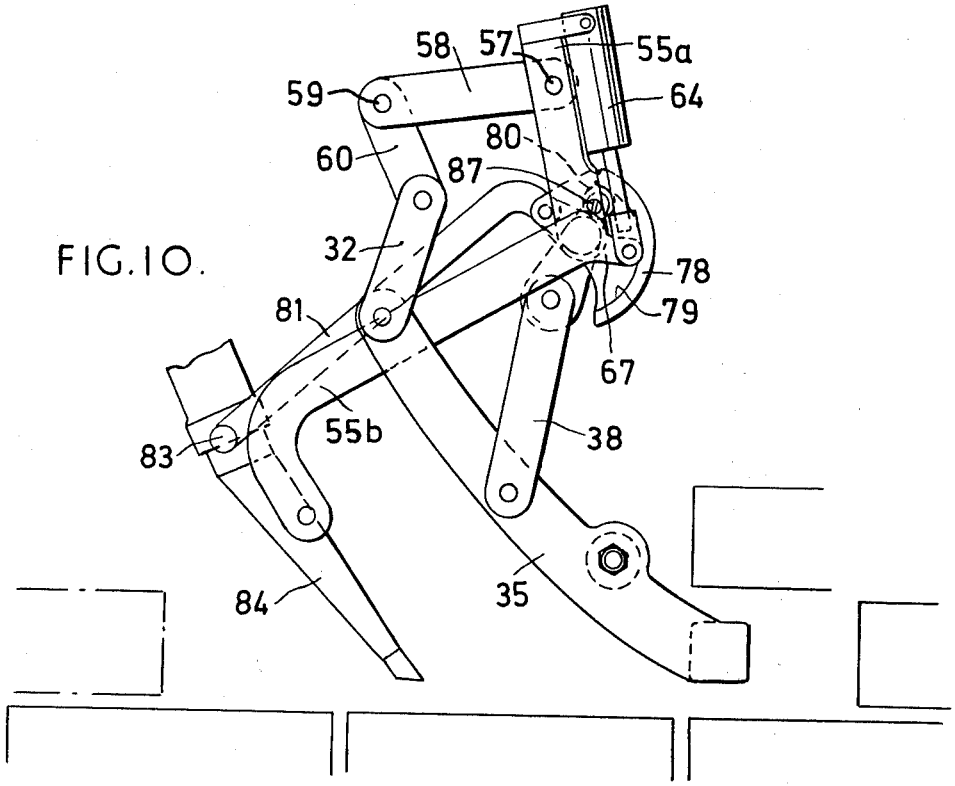
Figure 11:
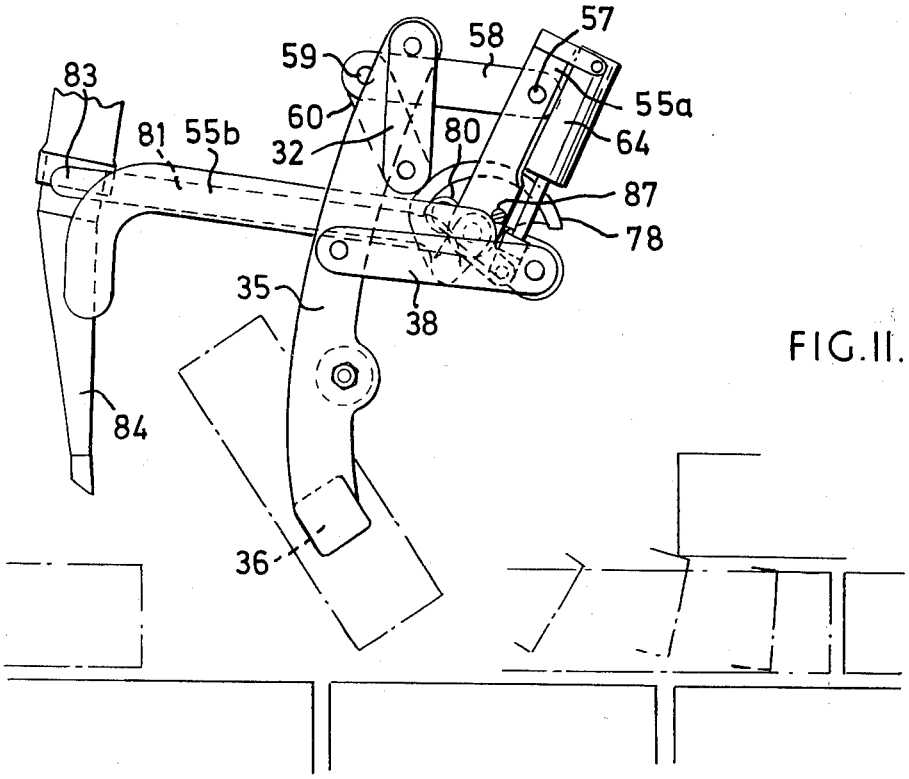

The piston rod 74 of the piston-and-cylinder arrangement 75 is now retracted rotating the drive arm 69 anti-clockwise about the shaft 50 until the clutch surface 71 re-engages with the clutch surface 54, the rotation of the drive arm 69 permitting the cam plate 78 to rotate clockwise under the spring pressure (referred to above) to the position shown in FIG. 10. Further retraction of the piston rod 74 moves the complete mortar-applying linkage assembly and nozzle upwardly to the fully retracted position shown in FIG. 11.

In operation of the apparatus, the articulated structure 11 on the vehicle 10 first positions the bricklaying and mortar applying head 20 in the required general position and then accurate alignment is effected via the telescopes 15, 16 and predetermined marks. The flexible hose 23 supplies mortar to the nozzle 84 which is fed with controlled amounts in the required sequence by the metering valve 24, whilst a cut-off valve (not shown) in the nozzle 84 gives accurate flow control. The nozzle linkage described above moves the nozzle 84 along a predetermined path where the mortar is required, which is mainly horizontally forward for one brick length and then vertically upward a brick height. This movement in conjunction with the metering valve 24 enables mortar to be dispensed in suitable combinations of horizontal and/or vertical runs.

Mortar is laid as above described and the brick gripper arms 35 pick up a brick by closing on one half of the long face, which also enables part bricks to be placed. Bricks are presented at the brick supply station with their long or 'stretcher' face and with any decorative facing in the correct orientation. Articulation of the brick gripper arms 35, movement of the head 20 and indexing mechanism 21, movement of the cross traverse member 19 and movement of the bracket 17 along the horizontal guideway 13, places the brick in its desired position on the previously laid mortar bed. This sequence is repeated over the required operational area and the upper assembly 12 then repositioned with respect to the predetermined marks.

It will be seen that rotation and indexing of the head 20 to a position in which the gripper arms 35 are at right angles to the guideway 13, combined with appropriate positioning of the cross traverse member 19 enables bricks or 'headers' to be laid across a wall. Movement of the cross traverse member 19 between alternate placing of 'stretcher' bricks enables cavity walls to be produced in brickwork, whilst changing the head 20 between lifts of working allows a cavity with one leaf of brick and one leaf of blockwork to be built.

The out reach of the cross traverse member 19, its position along the guideway 13 and movement up the vertical column 14 are indexed by response of their control mechanisms to reference points along the axes of movement. These being at half brick or half block increments. This in conjunction with the indexed rotation of the head 20 enables the laying pattern to be predetermined by the use of known means such as punched tape, cards, magnetic tape, rotating barrel programmes and the like, in combination with a prearranged supply of bricks from a magazine.

It will be appreciated that the brick gripper pads 36 may take any convenient form, for example, suction heads and that the alignment means may take the form of photo-electric cells, lasers, closed circuit television, or the like.

I claim:

1. An apparatus for positioning building elements comprising a first guideway;

a bracket mounted for movement along said guideway and having a second guideway extending at a right angle to said first guideway;

a cross-traverse member slidably mounted on said second guideway;

an indexing mechanism fixedly mounted on said cross-transverse member;

an element laying and mortar applying head rotatably mounted on said indexing mechanism about a vertical axis and connected to said mechanism for rotation thereby about said vertical axis, said indexing mechanism having first means for indexing said head in angular increments of motion about said vertical axis, said head including a bracket assembly, an element handling mechanism including a pair of gripper arms pivotally mounted on said bracket assembly, second means for moving said gripper arms horizontally towards each other to grip an element therebetween, third means for pivoting said gripper arms in unison in a vertical plane, a mortar applying nozzle pivotally mounted on said bracket assembly, and a drive arrangement mounted on said bracket assembly for pivoting said nozzle in a plane parallel to said vertical plane; and fourth means for supplying jointing material to said nozzle.

2. An apparatus as set forth in claim 1 which further comprises a pair of alignment telescopes horizontally mounted on said first guideway and a vertically mounted telescope on said guideway.

3. An apparatus as claimed in claim 1 including an articulated structure having a lower end rotatably mounted on a vehicle and an upper end mounting said first guideway thereof.

4. An apparatus as claimed in claim 3 including a vertical column mounted on the upper end of said articulated structure with said guideway member slidably mounted thereon and horizontally extending therefrom.

5. An apparatus as claimed in claim 1 wherein said third means includes a linkage pivotally mounting each element gripper member to said bracket assembly.

6. An apparatus as claimed in claim 5 wherein said third means further includes a fluid actuated piston-and-cylinder arrangement connected between said bracket assembly and a drive link forming part of said linkage, said piston-and-cylinder arrangement effecting said pivotal movement of said gripper arms in said vertical plane.

7. An apparatus as claimed in claim 5 wherein said drive arrangement includes a pair of articulated links having lower portions capable of limited pivotal movement relative to their respective upper portions by a fluid actuated piston-and-cylinder arrangement pivotally mounted on said bracket assembly, said nozzle being positioned between and pivotally mounted intermediate the ends thereof to the lower portions of said articulated links.

8. An apparatus as claimed in claim 7 wherein said drive arrangement further includes a nozzle displacement link and a cam plate pivotally mounted on the pivot axis of said articulated links, one end of said nozzle displacement link being pivotally connected to said nozzle and another end connected to said cam plate, pivotal movement of which causes displacement of said link to effect a substantially straight line motion of the nozzle outlet.

9. An apparatus as claimed in claim 8 including a two-armed drive member, a roller mounted on one of the arms of said drive member and a fluid actuated piston-and-cylinder arrangement connected to the other arm of said drive member, said piston-and-cylinder arrangement being pivotally mounted on said bracket assembly, the arrangement being such that pivotal movement of said cam plate is controlled by said roller.

10. An apparatus as claimed in claim 9 including a clutch interposed between said drive member and said articulated links, the arrangement being such that, in use, after a predetermined movement of said links, continued pivotal movement of said driving member causes disengagement of said clutch and a substantially vertical movement of the nozzle outlet via the cam plate and nozzle displacement link.

11. An apparatus as claimed in claim 1 wherein said indexing mechanism comprises a housing, a frame rotatably supporting said bracket assembly, ratchet-and-pawl means for effecting rotation of said bracket assembly and detent means for accurately positioning said bracket assembly relative to said frame.

12. An apparatus as claimed in claim 11 wherein said ratchet-and-pawl means comprises two pawl members and a ratchet wheel connected to said bracket, said pawl members being positioned, resp-ctively, on opposite sides of the ratchet wheel, and a pair of fluid actuated piston-and-cylinder arrangements mounted on said frame each operating one of said pawl members.

13. An apparatus as claimed in claim 11 including links positioned respectively at each end of said frame, said links mounting said frame for limited, arcuate movement relative to said housing.

* * * * *